United States Patent [19]

Van Horn

[11] 4,192,570

[45] Mar. 11, 1980

[54] INSULATED ELECTRICAL CONDUCTOR TERMINATION CONSTRUCTION

[75] Inventor: Robert H. Van Horn, Worthington, Ohio

[73] Assignee: Bell Telephone Laboratories, Incorporated, Murray Hill, N.J.

[21] Appl. No.: 935,475

[22] Filed: Aug. 21, 1978

[51] Int. Cl.[2] ..... H01R 9/08

[52] U.S. Cl. ..... 339/98

[58] Field of Search ..... 339/98; 29/749, 751, 29/753

[56] References Cited

U.S. PATENT DOCUMENTS

| | | | |
|---|---|---|---|
| 1,285,361 | 11/1918 | Pettibone | 339/99 L |
| 3,611,264 | 10/1971 | Ellis, Jr. | 339/99 |
| 3,877,771 | 4/1975 | Jensen et al. | 339/98 |
| 3,946,476 | 3/1976 | Mason | 29/749 |
| 4,017,140 | 4/1977 | Reavis, Jr. et al. | 339/98 |
| 4,046,446 | 9/1977 | Reavis, Jr. | 339/99 |

*Primary Examiner*—Joseph H. McGlynn

*Attorney, Agent, or Firm*—William H. Kamstra

[57] ABSTRACT

An insulated electrical conductor terminal assembly comprising a "U" shaped clip (10) having pairs of opposed and aligned slots (13, 14) in opposite flanges (11, 12), which slots (13, 14) terminate in conductor seatings (15) adapted to have insulated conductors (16, 17) frictionally fitted therein through the slots (13, 14) across the flanges (11, 12) in tandem pairs. The clip (10) and its retained conductors (16, 17) are then fitted about a plurality of two-bladed terminals (22), one blade (23) of each terminal being bifurcated and having insulation piercing edges (27) at the opening of the bifurcation (26) and the other blade (24) of each terminal being bifurcated and having insulation piercing edges (27) at the base of the bifurcation (26). The cutting edges (27) of the two blades (23, 24) being spaced apart within each blade (23, 24) equal to the spacing between the seatings (15) of each pair of conductor seatings (15). Multiple simultaneous connections are thus made by a plurality of conductor pairs (16, 17) to the same respective terminals (22).

5 Claims, 3 Drawing Figures

INSULATED ELECTRICAL CONDUCTOR TERMINATION CONSTRUCTION

TECHNICAL FIELD

This invention relates to electrical connector assemblies and particularly to such assemblies adapted to facilitate the connection of the conductors of multiconductor cables to corresponding connector contact terminals.

BACKGROUND ART

Although the physical design of communications and electronics systems has in recent years seen extensive advances in terms of simplification, miniaturization, circuit integration, and the like, the interconnection between system components and mounting frames still relies largely on individual conductors assembled in cables for power distribution and signal transmission. In many systems, terminations from the many circuit units are collected at common points where terminals are provided to which individual cable conductors must be joined. Although the art has offered improvements in terminating arrangements for making the electrical connections between the terminals and individual conductors, the problems of facilitating and speeding the individual joining of conductors and terminals remain. Both solder and solderless connections have been employed in the past, in the latter group appearing the well-known insulation piercing terminals. Electrical connection between such terminals and the cable conductors is achieved by slicing through the conductor insulation by means of bifurcated blades extending from the terminals, which blades at the same time seize the bared conductors to make the connections. This method has the obvious advantages that, not only is the tedious and time-consuming soldering step eliminated, but the necessity of first stripping the conductors is also avoided.

Conventionally, the individual cable conductors are first sorted and arranged on a first insulated member mounting the conductors in a pattern corresponding to the spacings of terminal blades retained in a second insulated block member. The two members are adapted to be fitted one to the other during which the blades function as described to make the electrical connections. A unitary connector assembly is thus realized which may be readily separated to permit wiring changes and repair of the connections should this eventually prove necessary. As mentioned, such insulation piercing connections have long been known in the art. One early such arrangement, for example, is described in the Nov. 19, 1918, U.S. Pat. No. 1,285,361 of J. E. Pettibone. There described is a clip means for retaining, side-by-side, a pair of insulated conductors which clip means is aligned with a pair of bifurcated blades. As the conductors and their retaining clip means are brought into engagement with blades, the insulation is pierced to make simultaneous dual electrical connections.

A more recent insulation piercing connector arrangement is disclosed in the patent of B. C. Ellis, Jr., U.S. Pat. No. 3,611,264, issued Oct. 5, 1971. In the connector arrangement there disclosed a plurality of bifurcated blade terminals make simultaneous electrical connections with corresponding conductors held in alignment between the teeth of an indexing strip. In the afore-cited and other prior art insulation piercing arrangements, single conductors make contact with individual bladed terminals. It frequently becomes necessary, however, to terminate more than one conductor on a corresponding individual bladed terminal. A bladed terminal for making such two-conductor connections is disclosed in the patent of R. P. Reavis, Jr., U.S. Pat. No. 4,040,446, issued Sept. 6, 1977. A terminal is there described which incorporates two bifurcated blades in one structure, the blades lying one above the other. The cutting portions of the blades, however, appear at opposite ends of the bifurcations, that is, the cutting portion of one blade lies at the open end of the bifurcation while that portion of the other blade lies at the base of the bifurcation. A first conductor, as it is manually forced between both blade bifurcations, is seated to the base of the latter blade where its insulation is pierced. A second conductor is then also forced between both blade bifurcations but only so far as the cutting edges of the other blade at its open end. Two conductors are thus sequentially connected to the two-bladed terminal. Although dual connections to a single terminal may in this manner be reliably achieved, the individual insertion of what, in many cases, may be large numbers of conductor pairs in their respective double-blades terminals remains tedious and time-consuming and, therefore, costly. It is to this problem of simplifying and facilitating the insertion of large numbers of conductor pairs in their respective terminals to which the connector assembly of this invention is chiefly directed.

SUMMARY OF THE INVENTION

The electrical connection of a plurality of insulated conductor pairs with corresponding single, insulation piercing terminals is simplified and facilitated in accordance with this invention in a connector assembly including a "U" shaped clip in which a plurality of cable conductor pairs are first sorted and loaded. Opposite flanges of the clip are provided with corresponding pairs of slots terminating in in-line seatings for the conductor pairs. The clip is loaded by inserting the conductors in corresponding opposing slots across the open side of the clip until fitted at the seating end of the slots at which points the conductors are frictionally retained. The loaded clip is now assembled with a terminal block mounting a plurality of double-bladed insulation piercing terminals corresponding in number and alignment with the tandem, in-line conductor seatings of the clip. Each of the terminals comprises a pair of blades having aligned bifurcations within which cutting edges are provided to slice through the conductor insulation. The cutting edges of one blade, however, lie at opening of the bifurcation while the cutting edges of the other lie at the base of the bifurcation in the manner of the Reavis terminal referred to hereinbefore. The loaded clip is adapted to fit about the terminal block and, when so fitted, the conductors of the pairs seated toward the clip flange edges pass through the terminal bifurcations to have the insulation pierced by the lower cutting edges of one of each of the blade pairs. The conductors seated inwardly of the clip flange edges are pierced by the upper cutting edges of the other of each of the blade pairs to achieve electrical contact. The loading clip thus fitted over the terminals of the terminal block is retained by spring clips at each end and may be readily dissassembled to disconnect the conductor as a group when necessary. Advantageously, the loading clip serves not only as the tool for making the simultaneous multiple connections, but, after assembly, also provides a strain relief for the cable conductors so connected.

BRIEF DESCRIPTION OF THE DRAWING

The features and advantages of a connector assembly according to the principles of this invention will be better understood from a consideration of the detailed description of the organization and operation of one illustrative embodiment thereof which follows when taken in conjunction with the accompanying drawing in which.

DETAILED DESCRIPTION

Figure 1:
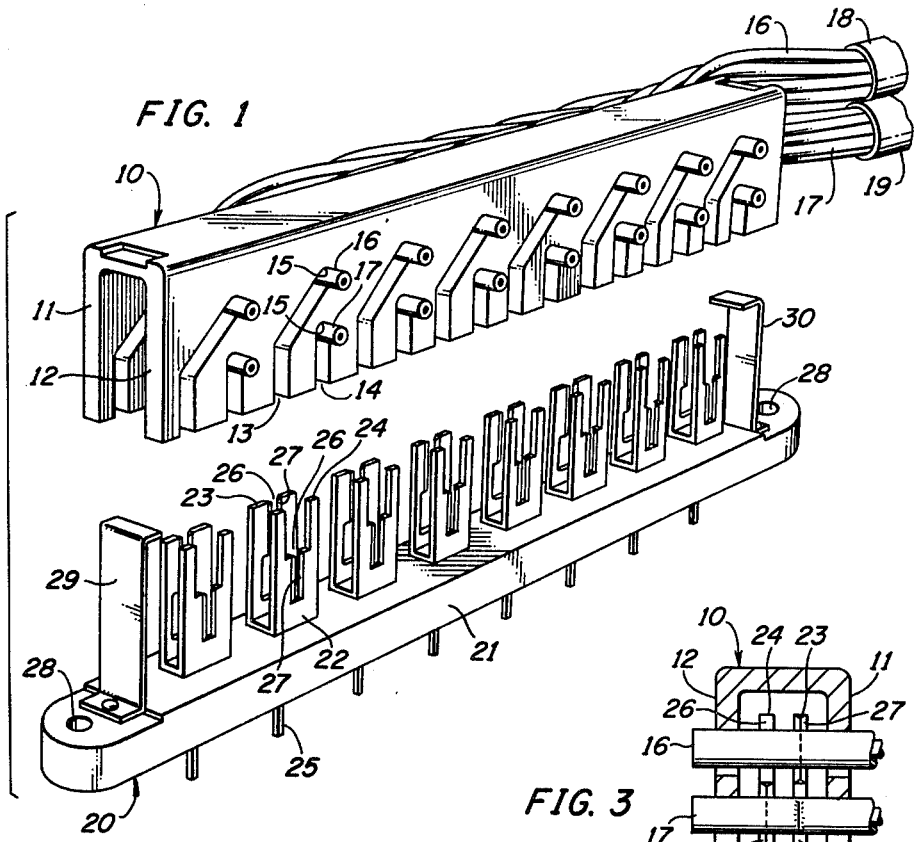
FIG. 1 is an exploded, perspective view of a loaded clip and terminal block assembly according to this invention immediately prior to final assembly.

One illustrative connector assembly according to this invention is shown in exploded view in FIG. 1 and comprises a substantially "U" shaped conductor loading clip 10 adapted for association with a terminal block 20. The flanges 11 and 12 of clip 10, which may be formed of plastic or steel coated with a suitable insulating material, each of which is provided with a plurality of pairs of adjacent slots 13 and 14, those of flange 12 only being visible in the figure. Slots 13 and 14 are aligned in correspondence with opposing similar slots in flange 11, and each slot terminates in a conductor seating 15. Slots 13 are each angled so that its conductor seating 15 is directly above (as viewed in the figure) the conductor seating 15 of an adjacent slot 14. Slots 13 and seatings 15 are dimensioned to frictionally receive conductors 16 and 17 of a pair of cables 18 and 19, only a portion of the latter cables being shown in the figure.

Figure 3:
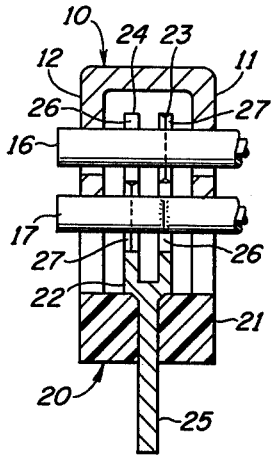
FIG. 3 is a cross-section end view of the assembly of FIG. 2 taken along the line 3—3.
Figure 2:
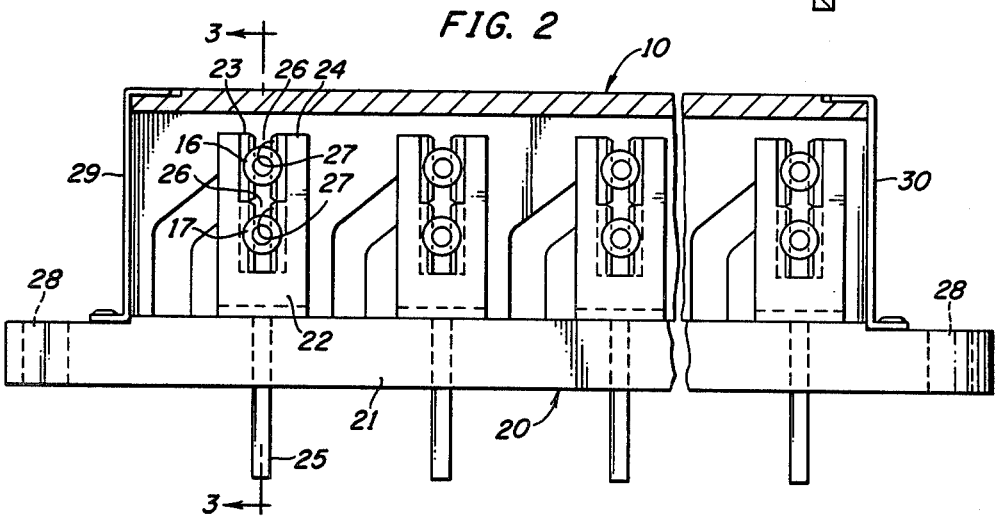
FIG. 2 is a slightly enlarged, assembled side view of the assembly of FIG. 1 shown broken and partially sectioned lengthwise to show representative conductor terminations.

Terminal block 20 comprises a base 21 mounting a plurality of insulation piercing terminals 22 shown in various views in FIG. 1 and in FIGS. 2 and 3, to which other figures reference may now also be had. For example, the terminal block can be the terminating portion of a printed wire board connector known widely as a card edge connector. Each of the terminals 22 is provided with a pair of blades 23 and 24 integrally extending from a common terminal pin 25. The pins 25 extend through and outwardly from base 21 and are adapted for permanent electrical connection with backplane wiring, or other system interconnections such as contacts mating with connecting fingers on printed wire boards. Blades 23 and 24 have formed therein in each terminal 22 a bifurcation 26 presenting for substantially half its length a pair of cutting edges 27 for piercing conductor insulation. Cutting edges 27 are oppositely disposed along the bifurcations 26 of blades 23 and 24. That is, cutting edges 27 of blade 23 of a terminal 22 extend for substantially half the length of bifurcation 26 downward from its mouth, the bifurcation when widening to its base to freely admit the outside diameter of a conductor with which electrical contact is to be made. Cutting edges 27 of blade 24, on the other hand, extend for substantially half the length of bifurcation 26 upward from its base, the bifurcation then similarly widening to its mouth. Base 21 may be provided as required with mounting holes 28 at each end.

With the details of a terminal block 20 and a conductor loading clip 10 according to this invention so far described in mind, an illustrative conductor connection operation thereof may now be considered. After ensuring the registration of the tandem pairs of conductors 16 and 17 retained by clip 10 with the corresponding bifurcations 26 of terminals 22, as shown in FIG. 1, clip 10 may be manually moved downwardly to bring those elements into engagement. At this point, clip 10 is forced further downwardly until open edges of flanges 11 and 12 seat on base 21 as shown in the section view of FIG. 2. During this latter movement, it is apparent that the first conductors 17 initially pass between cutting edges 27 of blades 23 where the insulation of these conductors is pierced. Further downward movement of clip 10 forces conductors 17 past the cutting edges 27 of blades 23 to the widened portion of the latter blade at which point the insulated conductors so pierced are out of metallic contact with blades 23. At blades 24, conductors 17 initially pass through the widened portions of the bifurcations 26 of blades 24, out of contact with either side, and, as the downward movement of clip 10 continues, the insulation of conductors 17 is pierced by the lower cutting edges 27 of blades 24 to make the electrical connections. Conductors 16 on the other hand, come to rest at one point between the upper cutting edges 27 of blades 23, where the electrical connections are made, and a second point, at the widened portion of bifurcations 26 of blades 24. The final disposition of conductors 16 and 17 is more clearly seen in the section views of FIGS. 2 and 3. Simultaneous connections of conductor pairs with single terminals are thus, advantageously made by means of a loading clip 10 according to this invention. Clip 10 after its seating on base 21, is retained there by a pair of spring clips 29 and 30 affixed at each end of base 21, which clips are adapted to engage notches 31 and 32 formed at each end of the base of clip 10. After the assembly of clip 10 and terminal block 20 as afore-described, clip 10, having served as a tool for achieving the electrical connection of its retained conductors, also advantageously serves as a means for providing strain relief for the same conductors.

What has been described is considered to be only one specific connector arrangement according to the invention and it is to be understood that various and numerous other arrangements may be devised by one skilled in the art without departing from the spirit and scope thereof as defined by the accompanying claims.

What is claimed is:

1. An electrical connector construction comprising terminal block means mounting a plurality of insulation piercing terminals, each of said terminals comprising a pair of opposing bifurcated blades, one of said pair having cutting edges at the opening of a bifurcation, the other of said pairs having cutting edges at the base of a bifurcation, and a substantially "U" shaped clip having a pair of opposing flanges, said flanges having corresponding pairs of slots extending inwardly from the edges of said flanges, said pairs of slots terminating in corresponding pairs of conductor seatings aligned perpendicularly from said flange edges and in registration with said blade bifurcations, said clip being moveable into engagement with said terminal block means for simultaneously inserting conductor pairs when loaded in said conductor seatings across said flanges through said slots in said blade bifurcations of corresponding ones of said terminals.

2. An electrical connector construction comprising a row of conductor insulation piercing terminals, each of said terminals comprising a pair of adjacent blades each having a bifurcation from one end of a blade, said bifurcation of one of said blades having first insulation piercing edges extending from said one end inwardly along a partial length of said bifurcation, said bifurcation of the other of said blades having second insulation piercing edges extending outwardly along a partial length of said last-mentioned bifurcation from its base, and means for simultaneously inserting a first insulated conductor between said second cutting edges of each of said terminals and a second conductor between said first cutting edges of each of said terminals comprising a substantially "U" shaped clip having a pair of opposing flanges, said flanges having corresponding pairs of slots extending inwardly from the edges of said flanges, said pairs of slots terminating in corresponding pairs of conductor seatings aligned perpendicularly from said flange edges in registration with said blade bifurcations for seating in each of said pairs of seatings, said first and second conductors.

3. Electrically insulated conductor terminating apparatus for simultaneously terminating a plurality of conductor pairs at a corresponding plurality of two-bladed insulation piercing terminals, each of said terminals having first insulation piercing edges at the opening of a bifurcation of one of said blades and second insulation piercing edges at the base of a bifurcation of the other of said blades, said apparatus comprising a substantially "U" shaped clip having a pair of opposing flanges, said flanges having a first plurality of slots terminating in a first plurality of corresponding conductor seatings and a second plurality of slots terminating in a second plurality of corresponding conductor seatings, corresponding seatings of each of said first and second plurality of seatings being aligned perpendicularly from the edges of said flanges and being perpendicularly spaced apart a distance less than the distance between said base of said bifurcation of said blades and said opening of said bifurcation of said blades, said seatings of each of said first and second plurality of conductor seatings being further laterally spaced apart to register with respective ones of said terminal blade bifurcations.

4. Apparatus as claimed in claim 3, also comprising a plurality of insulated electrical conductors mounted respectively in said first and second plurality of conductor seatings across said flanges of said clip.

5. Electrically insulated conductor terminating apparatus for simultaneously terminating a first and a second conductor at a single electrical insulation piercing terminal having a pair of parallel bifurcated blades, one of said blades having first insulation piercing edges at the opening of its bifurcation, the other of said blades having second insulation piercing edges at the base of its bifurcation, said apparatus comprising a substantially "U" shaped clip having a pair of opposing flanges, each of said flanges having a corresponding pair of conductor seatings therein in a line perpendicular to the edges of said flanges accessed by slots opening at said edges of said flanges, said seatings being spaced apart in said flanges to align substantially with corresponding insulation piercing edges of said bifurcations of said pair of blades.

* * * * *